US007578244B2

(12) United States Patent
Williams, Jr.

(10) Patent No.: US 7,578,244 B2
(45) Date of Patent: Aug. 25, 2009

(54) EASILY ASSEMBLED AND REPAIRABLE PLASTIC SHIPPING PALLET

(76) Inventor: Larry Thomas Williams, Jr., 227 Harrington Rd., Wadesboro, NC (US) 28170

( * ) Notice: Subject to any disclaimer, the term of this patent is extended or adjusted under 35 U.S.C. 154(b) by 11 days.

(21) Appl. No.: 11/395,598

(22) Filed: Mar. 31, 2006

(65) Prior Publication Data

US 2006/0169185 A1 Aug. 3, 2006

Related U.S. Application Data

(63) Continuation-in-part of application No. 10/800,955, filed on Jun. 7, 2004, now abandoned.

(51) Int. Cl.
*B65D 19/12* (2006.01)

(52) U.S. Cl. ..... 108/56.3; 108/57.25; 108/901

(58) Field of Classification Search ..... 108/57.25, 108/51.11, 901, 902, 56.1, 56.3, 57.22
See application file for complete search history.

(56) References Cited

U.S. PATENT DOCUMENTS 3,685,463 A * 8/1972 Francis ..... 108/56.3
3,878,796 A * 4/1975 Morrison ..... 108/56.1
4,765,252 A * 8/1988 Shuert ..... 108/55.1
5,365,859 A * 11/1994 Schrage ..... 108/56.1
5,417,167 A * 5/1995 Sadr ..... 108/57.19
5,440,998 A * 8/1995 Morgan et al. ..... 108/57.18
5,456,189 A * 10/1995 Belle Isle ..... 108/57.17
5,458,069 A * 10/1995 Stolzman ..... 108/56.3
5,791,502 A * 8/1998 Bietz et al. ..... 211/192
5,941,179 A * 8/1999 Herring ..... 108/57.19
7,004,083 B2 * 2/2006 Ramirez von Holle et al. ... 108/57.25
2002/0112653 A1 * 8/2002 Moore et al. ..... 108/57.25

FOREIGN PATENT DOCUMENTS

GB 2143503 * 2/1985

* cited by examiner

*Primary Examiner*—Hanh V Tran
(74) *Attorney, Agent, or Firm*—Ralph H. Dougherty

(57) ABSTRACT

An easily assembled and repairable plastic shipping pallet includes two or more plastic runner rails and multiple plastic cross boards secured perpendicularly to the top and bottom of the runner rails by pins and pin receiver/retainers. The pins engage and retain the cross boards by a slide and snap-in mechanism. This construction allows for rapid and easy repair of a pallet that may become damaged. The method of assembly includes placing pairs of holes of the slats over mating pairs of pegs in the proper orientation; and sliding each slat a short distance to engage each projection in its mating recess.

7 Claims, 6 Drawing Sheets

EASILY ASSEMBLED AND REPAIRABLE PLASTIC SHIPPING PALLET

CROSS REFERENCE TO RELATED APPLICATION

This application is a continuation-in-part of my U.S. patent application Ser. No. 10/800,955, filed Jun. 7, 2004 now abandoned.

FIELD OF THE INVENTION

The present invention relates to a relates to shipping and storage pallets in general, and more particularly to easily assembled, reusable, and easily repairable shipping and storage pallets formed from plastic parts.

The present invention relates to various shipping pallets and more particularly to an easily assembled and repairable plastic shipping pallet that included two or more plastic runners or rails each including multiple top and bottom pegs for board mounting. Two or more plastic runner rails are secured to multiple plastic cross boards to form a pallet.

BACKGROUND OF THE INVENTION

Wooden pallets can be expensive, often break and become unusable after one or more uses, and can create disposal problems. Typically, wooden pallets are assembled with metal nails, screws, and bolts. Pallets are often stored, with or without loads thereon, in areas open to weather, which causes the metal fasteners to rust or otherwise deteriorate. Broken pallets create hazards to persons working around them or on them, and objects in their vicinity, and sometimes cause difficulty in handling the product stored or carried by the pallet. Therefore, it is desirable to have a plastic pallet that is capable of multiple uses and is easily repaired on site, when damaged. A plastic pallet is totally recyclable, thus eliminating the disposal problem.

It is also desirable to have a pallet that is readily repairable on site when damaged.

The invented plastic pallet is sufficiently durable to transport goods from one destination to another worldwide. Further, a forklift, pallet jack, or lifting crane can be easily used to lift or move this plastic pallet (i.e., load or unload it).

DESCRIPTION OF THE PRIOR ART

Applicant is aware of the following U.S. patents concerning plastic pallets.

| U.S. Pat. No. | Inventor | Title |
|---|---|---|
| U.S. Pat. No. 5,417,167 | Sadr | Plastic Pallet |
| U.S. Pat. No. 5,365,859 | Schrage | Recyclable Plastic Pallet |
| U.S. Pat. No. 5,456,189 | Isle | Reusable Shipping Pallet Formed from Extruded Plastic Parts Which Are Easily Assembled and Disassembled |
| U.S. Pat. No. 5,458,069 | Stolzman | Plastic Skid and Method of Manufacture |
| U.S. Pat. No. 5,941,179 | Herring | Variable-configuration pallet of modular construction |
| U.S. Pat. No. 5,440,998 | Morgan IV | Plastic pallet assembly and method |

Although the present invention has some similarities to the foregoing inventions, there are distinctive differences between the present invention and the patented pallet inventions.

Sadr U.S. Pat. No. 5,417,167 discloses a pallet which requires a screw or screws to fasten a deck board onto a stringer. It also uses clamps or lugs within the pallet, and a tool (which will damage the boards) is required for disassembling the pallet.

Schrage U.S. Pat. No. 5,365,859 teaches a pallet which requires plastic nails or heat stake to fasten slats to rails. By using plastic nails in this pallet one can reduce or eliminate press fit or heat stake procedures.

Isle U.S. Pat. No. 5,456,189 discloses a collapsible pallet that uses a ultrasonically welded cup along with other conventional securing means.

Stolzman U.S. Pat. No. 5,458,069 teaches a pallet which requires a tool for rotating and engaging a nut with a threaded post. The posts are ultrasonically welded to the cross members.

Herring U.S. Pat. No. 5,941,179 describes a pallet that uses blocks and needs to press fit the board onto the runner.

Morgan IV U.S. Pat. No. 5,440,998 employs a mechanical screw-in spike or stud, a drive rivet to cap the spike after board mounting, and hot upset of the integral spikes or studs. A supplemental adhesive is applied on a flat surface adjacent to each spike for safety. The pallet must be sent off-site for repairs.

SUMMARY OF THE INVENTION

An easily assembled and repairable plastic pallet includes two or more plastic runner rails, with multiple top and bottom pegs for cross board mounting. Multiple plastic cross boards are secured to the plastic runner rails to form a pallet. A unique locking mechanism is provided for each intersection of a cross board and a runner rail. In the present invention, the board or slat mounting process is carried out with a molded-on locking device for securing a slat in place, unlike the prior art patents. The runner/rail pegs are engaged securely by the slats, eliminating the need for additional means of securing. Finally, the invented pallet can be assembled or disassembled and repaired at any location, including on site (at the place of use).

Accordingly, an easily assembled and repairable plastic shipping pallet is provided, which has securely fastened parts, and which is sufficiently durable to transport goods from one destination to another worldwide. This pallet can be easily assembled and/or repaired, simply by engaging and snapping the pieces of plastic material together. After placing goods onto this pallet, a pallet jack or forklift (the two most common pieces of machinery) is used to lift, and move the pallet. Advantageously, the pallet has recesses in the runner rails to accommodate such lifting machinery.

OBJECTS OF THE INVENTION

The principal object of the invention is to provide an improved pallet for shipping and storage.

Another object of the invention is to provide a pallet which is reusable.

Another object of the invention is to provide a pallet which is easily assembled at the point of shipment and easily disassembled at the point of destination.

Another object of the present invention is to provide a pallet which is particularly compact when disassembled, and thus easy to transfer to another location for reuse.

A further object of this invention is to provide a method of assembling a shipping and storage pallet without tools.

Another object of the invention is to provide a shipping and storage pallet with interchangeable parts.

Another object of the invention is to provide a pallet which, when damaged, is easily repairable at the point of use by replacing only the damaged parts.

BRIEF DESCRIPTION OF THE DRAWINGS

The foregoing and other objects will become more readily apparent by referring to the following detailed description and the appended drawings in which.

DETAILED DESCRIPTION

Figure 1:
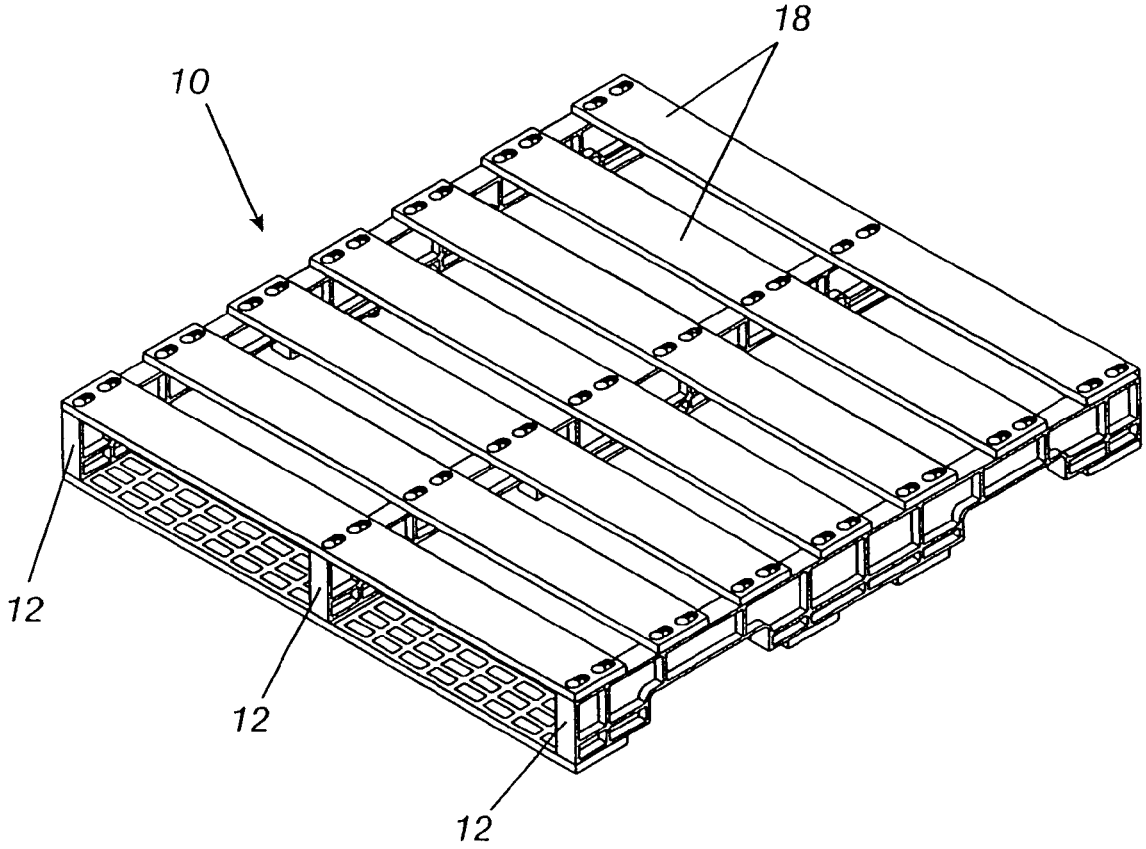
FIG. 1 is a perspective view of an assembled pallet according to the invention.

Referring now to the drawings, and particularly to FIG. 1, the invented pallet 10 is made from two distinct molded plastic parts, a runner (or support rail or beam) 12, and a cross board or slat 18. The support rail 12 may be a solid elongated member or it may have with cutout portions or recessed portions 14, as shown in Figures, to reduce its weight. The support rail can also be provided with a pair of lower recesses 16 to accommodate the lifting members of a fork lift. Pegs 20, 22 are molded onto the top and bottom of each support rail at spaced intervals, as shown. Peg receiving holes 24, 26 are provided in each slat 18.

Preferably, the head of one of each pair of pegs is slightly larger than the head of the other of the pair for correct board mounting, and one of each pair of receiving holes in the cross board is slightly larger than the other hole. This assures that the slat can be inserted in only one orientation, with the attendant result that the assembled pallet is very sturdy.

The plastic cross boards and runner rails are preferably ribbed to provide a light weight, yet strong pallet. The plastic used for the cross boards and runner rails is strong and not friable nor subject to shattering when struck sharply or dropped. Elastomers can be added to the selected plastic material to provide the desired toughness, resilience, and flexibility. The cross boards and runner rails of the repairable plastic pallet are preferably made from high density polyethylene (HDPE), polypropylene (PP), or a mixture thereof, and can be virgin or recycled material. The plastic can include a foaming agent or a gas to form a stronger and lighter weight pallet. Other plastic materials that can also be used include polypropylene, polyolefins, polyesters, polyamides, polycarbonates, vinyl esters, epoxy resins, polyethylene, ultra high molecular weight polyethylene, acrylonitrile-butadiene-styrene, fiber reinforced plastic, fiber reinforced vinyl ester, fiber reinforced epoxy, thermoplastic and thermosetting plastic. Fibers used for reinforcing can include glass fibers or fiberglass, carbon, basalt, or other fibers.

Figure 5:
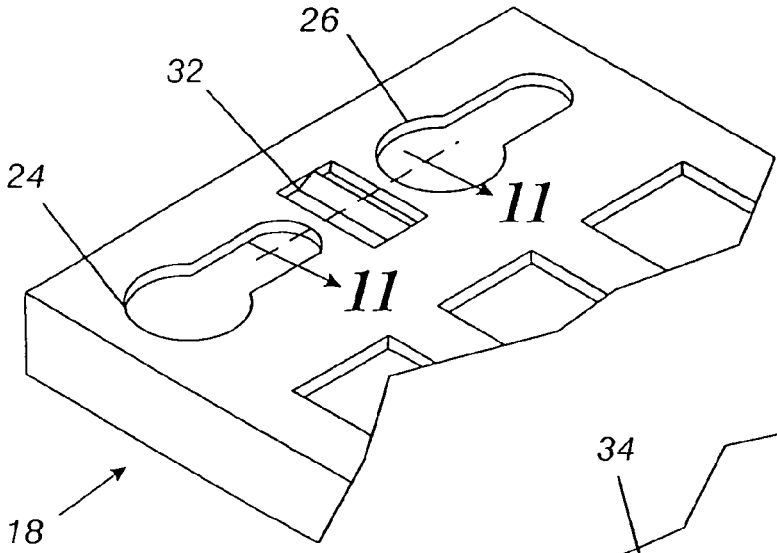
FIG. 5 is an enlarged partial isometric view of one end of the bottom of the deck board of FIG. 4 showing the connecting mechanism.
Figure 6:
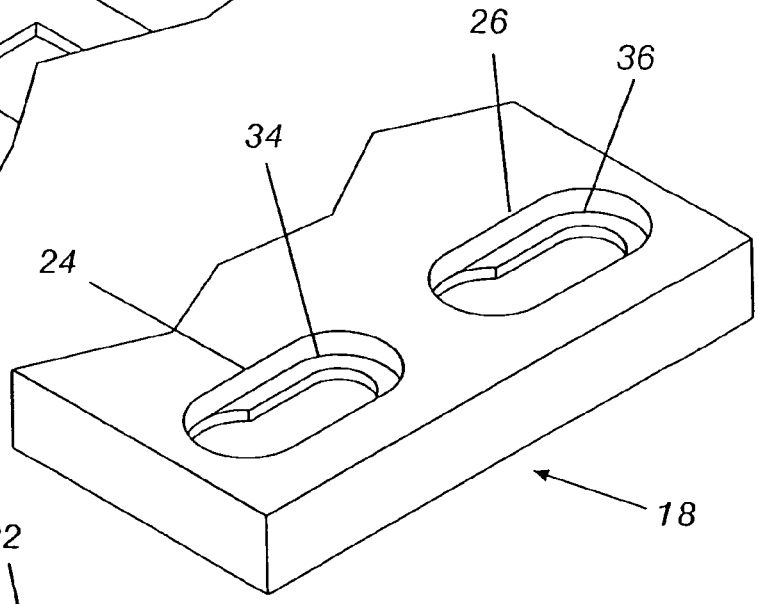
FIG. 6 is an enlarged partial view of the top of a top deck board.
Figure 7:
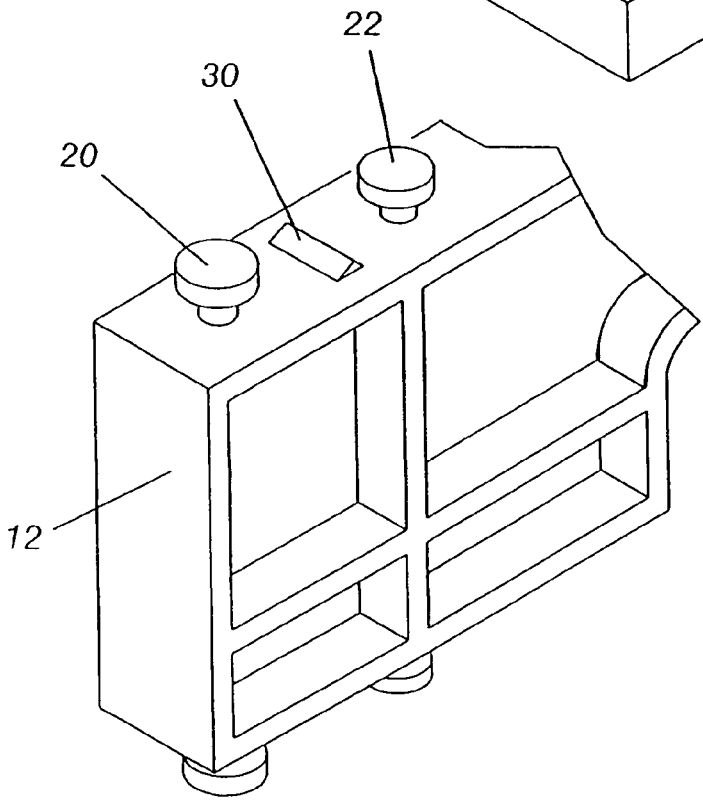
FIG. 7 is an enlarged partial isometric view of one end of a runner showing details of mounting pegs and the locking mechanism.
Figure 8:
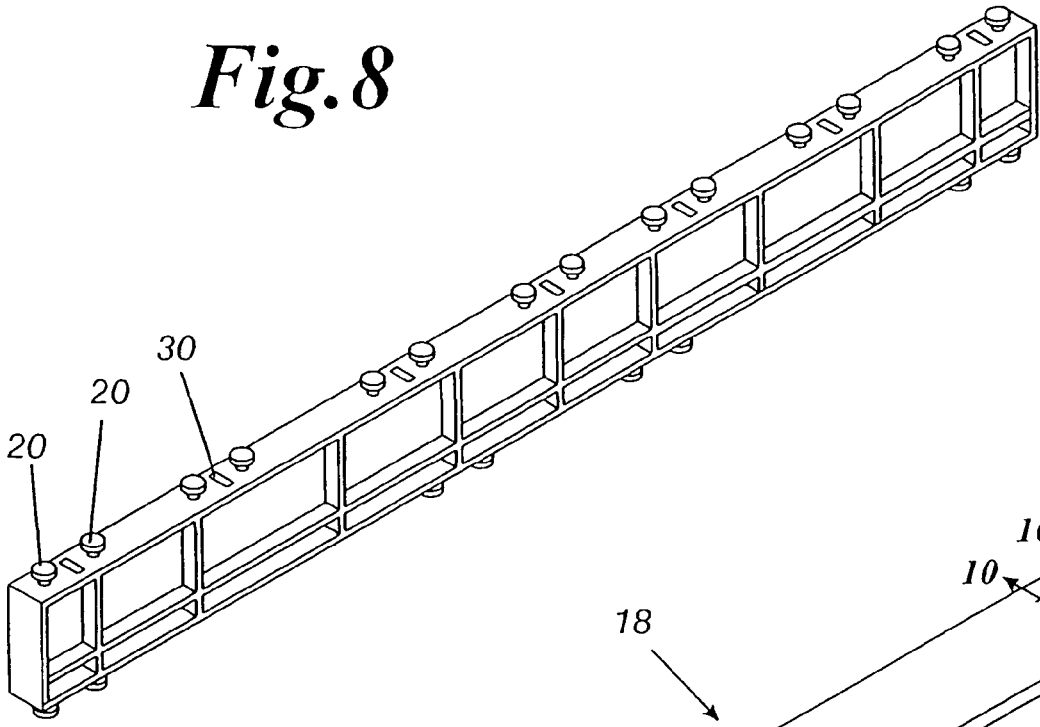
FIG. 8 is an isometric view of an alternative runner which can be used on the pallet.

As shown, a molded on plastic projection is adapted to be received in a mating recess in the slat. A retaining mechanism, which firmly locks each slat into place, is located between each pair of pegs (see FIGS. 5 and 6). A projection 30 is molded into beams 20 between each pair of pegs 20, 22. The height of the projection 30 is generally about 1/16 inch in height, but can be from about 1/32 to 3/8 inch. A mating recess 32 is molded into each slat 18.

Figure 11:
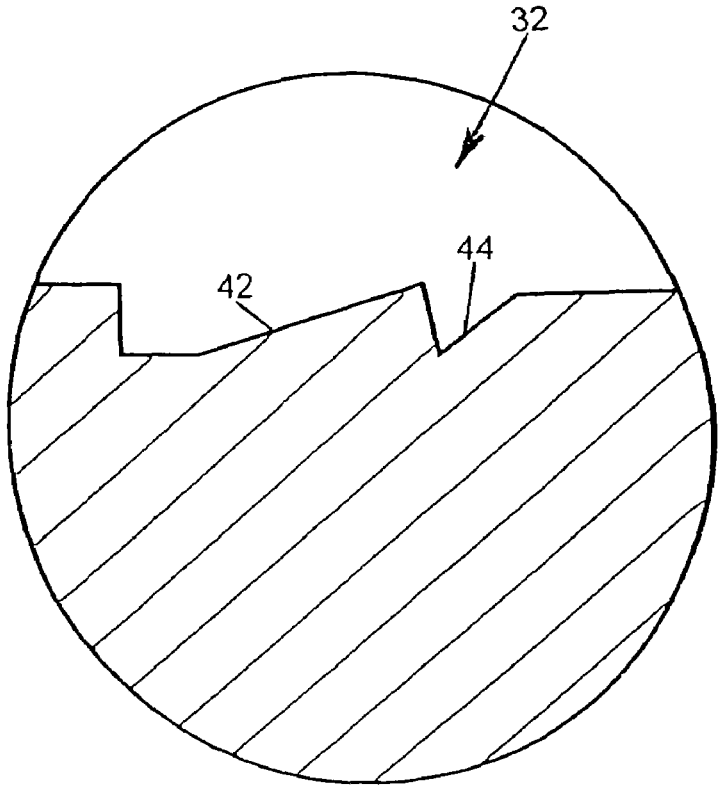
FIG. 11 is a cross-sectional view taken along line 11-11 of FIG. 5.

The preferred mating recess 32 of the slat retaining mechanism is shown in FIG. 11, and has an inclined portion and a recess at the end of the inclined portion to form a snap-in retainer for receiving the mating projection 30 of the runner.

The pairs of pins or pegs 20, 22 are spaced the desired distance from each adjacent pair to properly locate the slats, each of which is provided with mating slotted holes 24, 26 to receive and retain the pins 20, 22 therein. The slotted holes 24, 26 each have a ledge 34, 36 for engagement with the underside of the head of the peg 20 or 22. Properly positioned slats are coplanar with the tops of the pins, so that there is no projection nor catch-point.

Each runner has a series of pegs on its face, which are shown in FIG. 1 as 7 pairs of pegs on the upper face of the runner. As many pair of pegs are provided as the number of slats intended to engage the particular face of the runner. The pairs create stability and stiffness in the assembled pallet, and prevent the pallet from disassembling itself when in use, even in strenuous or high impact situations.

The slats 18 engaging the top of the runner are shown as evenly spaced, but they can be set at any desired spacing for a particular load. The slats on the bottom of the runner are shown as being spaced with gaps, which may be for reduction of weight and reduction of materials, which are economic considerations, or to accommodate lifting devices such as fork lifts and loading cranes. Of course, the same number and spacing of slats can be provided on both the top and bottom of the pallet. That is, the top and bottom shown can be interchangeable, and any desired configuration can be used for the top or the bottom, or both.

The preferred method of assembly of a pallet is to place the desired number of runners, preferably three, on a generally flat surface with the pegs facing up and down. The slats 18 are placed with holes 24, 26 over the pegs 20, 22 in the proper orientation, and slid a short distance to engage each projection 30 in mating recess 32.

On one end of each runner, the first pair of pegs may be oriented in opposite direction than the others. That is, the peg heads are oriented so the slat is mounted by sliding it in the opposite direction from the other slats of the pallet. The slat can be positioned in only one direction. This strengthens the pallet and prevents the slat from being jarred loose because of engagement by a forklift or pallet jack, or by rough handling. When properly positioned the tops of the pegs on the runner are flush with top of the slat, and the slat is resting flush on the runner. Then the slat is moved in a sliding fashion with slight force, so that the projection 30 is engaged in mating slot 32 in the slat, securing the slat 18 in place. This procedure is repeated until all of the top slats are in place.

The other side of the pallet is assembled by turning the pallet over and repeating the process.

To disassemble the pallet, remove a slat from a runner using slight force to push or pull on the slat to disengage the slat from the locking projection. Continue until all desired slats are removed.

The pallet can be completely or partially disassembled, as necessary for repair or replacement of a damaged part, or it can be completely disassembled for shipment of pallet parts.

ALTERNATIVE EMBODIMENTS

Figure 9:
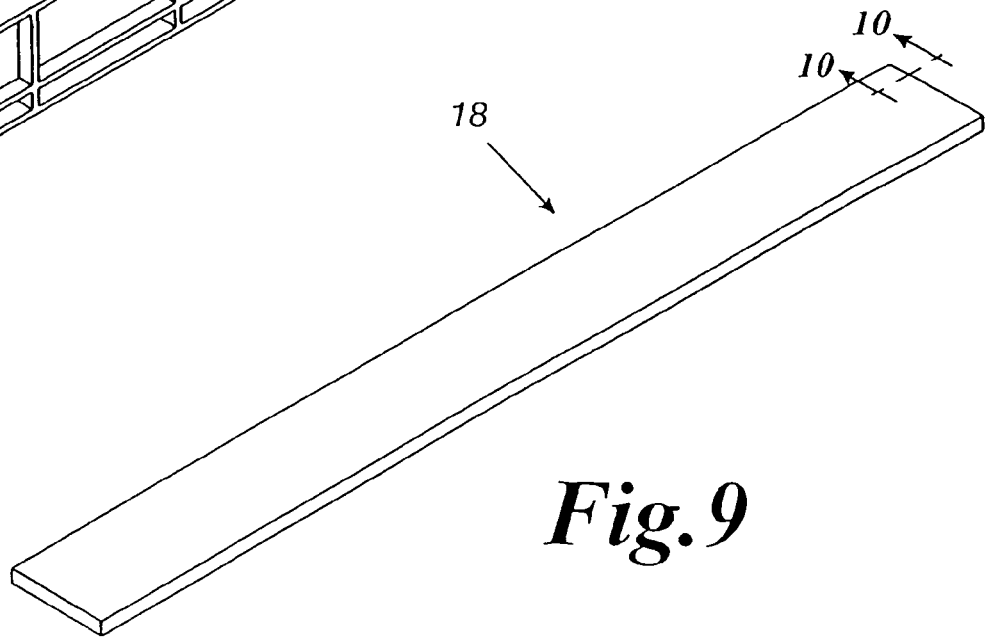
FIG. 9 is an isometric view of an alternative deck board or slat which can be used on the pallet.
Figure 10:
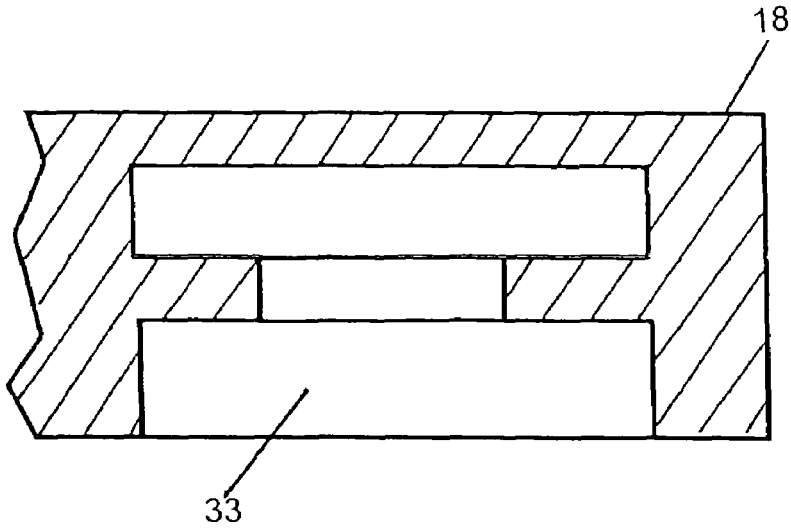
FIG. 10 is a cross-sectional view taken along line 10-10 of FIG. 9.

An alternative slat embodiment is shown in FIGS. 9 and 10 wherein the pin retaining slot 33 is molded into the slat without being exposed on the face of the slat, with all other aspects of the engagement and locking mechanism remaining the same.

Figure 2:
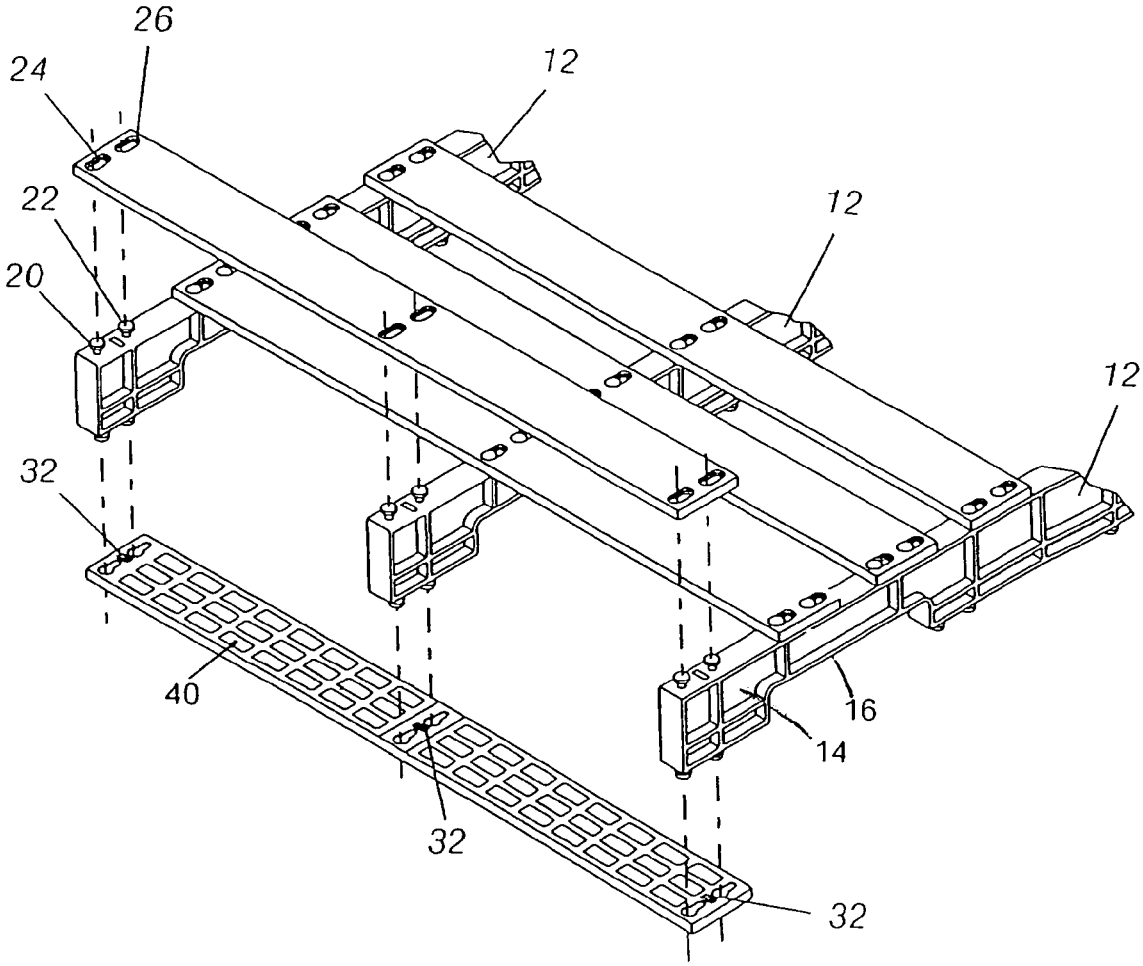
FIG. 2 is a partial exploded isometric view of a portion of the pallet of FIG. 1 showing details of the pallet parts.
Figure 3:
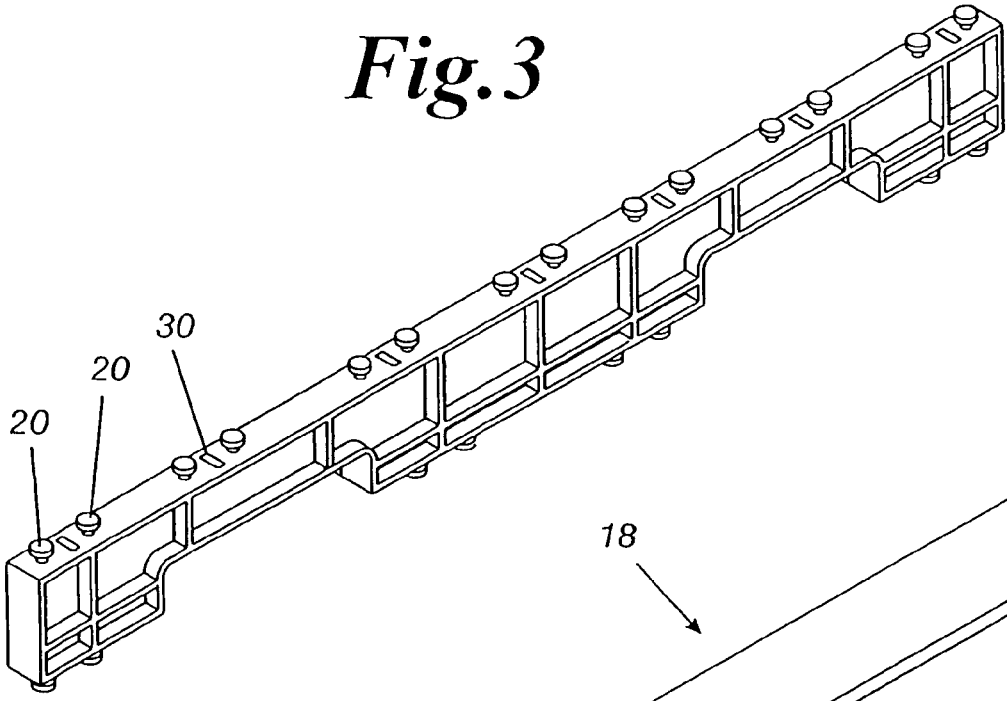
FIG. 3 is an isometric view of one runner of the pallet.
Figure 4:
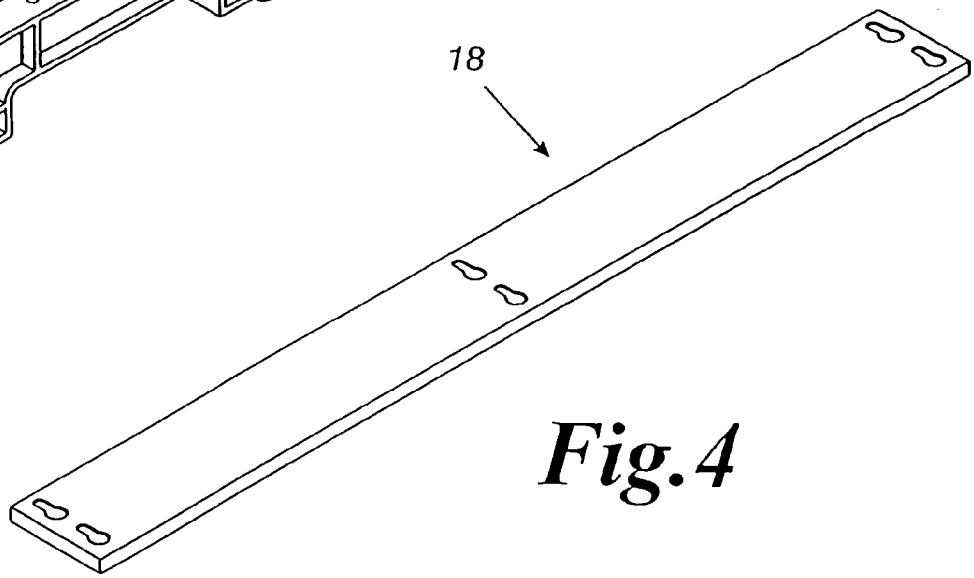
FIG. 4 is an isometric view of a single deck board or slat.

The slats can have recesses 40 molded into their sides to reduce their weight without sacrificing strength, as shown in FIG. 2.

SUMMARY OF THE ACHIEVEMENT OF THE OBJECTS OF THE INVENTION

From the foregoing, it is readily apparent that I have invented a pallet for shipping and storage, which is reusable, which is easily assembled at the point of shipment and easily disassembled at the point of destination, which is particularly compact when disassembled, and thus easy to whereby to transferring to another location for reuse, which has interchangeable parts, and when the pallet is damaged is easily repairable at the point of use by replacing only the damaged parts. I have also invented a method of assembling a shipping and storage pallet without tools faster and more economically than heretofore has been possible.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An easily repairable plastic pallet, comprising:

at least two elongated plastic runners, each of said runners having a top edge, a bottom edge, and a pair of opposed sides, said top edge and said bottom edge each being provided with pairs of integral pegs extending generally normal to the respective edge, each peg having a generally cylindrical shank and a head at the end of said shank spaced from the edge of the runner on which the peg is located, said head having a larger cross-sectional dimension than that of said shank;

at least two upper slats, each of which is provided with openings therethrough to receive and retain one of said pegs;

at least two lower slats, each of which is provided with pairs of transversely adjacent openings therethrough, each such opening having a ledge therein to receive and retain one of said pegs; and a slat retaining mechanism comprising an integral raised locking projection between each pair of pegs on said runner, and a corresponding mating recess in each of said slats to receive said projection, said mating recess having an inclined portion and a recess at the end of the inclined portion to form a snap-in retainer to receive said raised projection.

2. A pallet according to claim 1, wherein each of said runners is provided with a pair of lower recesses at spaced intervals.

3. A pallet according to claim 1, wherein the material of said pallet is selected from the group consisting of polypropylene, polyolefins, polyesters, polyamides, polycarbonates, vinyl esters, epoxy resins, polyethylene, ultra high molecular weight polyethylene, acrylonitrile-butadiene-styrene, fiber reinforced plastic, fiber reinforced vinyl ester, fiber reinforced epoxy, thermoplastic and thermosetting plastic.

4. A pallet according to claim 3, wherein said fiber reinforced plastic contains fiberglass.

5. A pallet according to claim 1 which is made from a plastic material selected from the group consisting of high density polyethylene (HDPE), polypropylene (PP), or a mixture thereof.

6. A pallet according to claim 1 wherein each of said integral pegs has a substantially flat end surface on its head.

7. A method of assembling a plastic pallet without tools, comprising:

providing a desired number of plastic runners, each having a top edge and a bottom edge provided with pairs of pegs extending generally normal to the respective edge, each peg having a head spaced from the edge of the runner on which it is located, and an integrally raised locking projection located centrally to each pair of pegs;

providing a desired number of slats, each having pairs of transversely adjacent holes therethrough for mating with said pairs of pegs, each hole having a ledge therein, and each slat having a mating recess between each pair of holes for receiving said projection said mating recess having an inclined portion and a recess at the end of the inclined portion;

placing the plastic runners on a generally flat surface with the pegs facing upward and downward;

placing the pairs of holes of the slats over the pairs of pegs in the proper orientation; and sliding each slat laterally a short distance to engage each projection in its mating recess, thereby locking each slat in the proper orientation.

* * * * *